US006354378B1

(12) United States Patent
Patel

(10) Patent No.: US 6,354,378 B1
(45) Date of Patent: Mar. 12, 2002

(54) METHOD AND APPARATUS FOR FORMATION ISOLATION IN A WELL

(75) Inventor: Dinesh R. Patel, Sugar Land, TX (US)

(73) Assignee: Schlumberger Technology Corporation, Sugarland, TX (US)

( * ) Notice: Subject to any disclaimer, the term of this patent is extended or adjusted under 35 U.S.C. 154(b) by 0 days.

(21) Appl. No.: 09/489,861

(22) Filed: Jan. 24, 2000

Related U.S. Application Data

(63) Continuation-in-part of application No. 09/441,817, filed on Nov. 17, 1999, now Pat. No. 6,302,216.

(60) Provisional application No. 60/117,304, filed on Jan. 26, 1999, provisional application No. 60/108,910, filed on Nov. 18, 1998, and provisional application No. 60/108,953, filed on Nov. 18, 1998.

(51) Int. Cl.[7] ..... E21B 34/10

(52) U.S. Cl. ..... 166/374; 166/321; 166/325

(58) Field of Search ..... 166/325, 321, 166/329, 373, 374

(56) References Cited

U.S. PATENT DOCUMENTS

| | | | | |
|---|---|---|---|---|
| 4,230,185 A | | 10/1980 | Fredd | |
| 4,253,524 A | | 3/1981 | Erickson | |
| 4,341,266 A | * | 7/1982 | Craig | 166/317 |
| 4,441,558 A | | 4/1984 | Welch et al. | |
| 4,470,464 A | * | 9/1984 | Baldenko et al. | 166/325 |
| 4,505,341 A | * | 3/1985 | Moody et al. | 175/65 |
| 4,688,593 A | | 8/1987 | Pringle et al. | |
| 4,697,638 A | | 10/1987 | Knight | 166/65.1 |
| 4,856,595 A | | 8/1989 | Upchurch | 166/374 |
| 5,058,674 A | | 10/1991 | Schultz et al. | 166/264 |
| 5,240,072 A | | 8/1993 | Schultz et al. | 166/169 |
| 6,065,355 A | | 5/2000 | Schultz | 73/864 |

* cited by examiner

*Primary Examiner*—Thomas B. Will
*Assistant Examiner*—Zakiya Walker
(74) *Attorney, Agent, or Firm*—Trop, Pruner & Hu P.C.

(57) ABSTRACT

An isolation system and method for use in a wellbore that passes through a formation includes a flow conduit capable of receiving a fluid flow from the formation and an isolation system coupled to the flow conduit and including one or more uni-directional flow control devices. Each uni-directional flow control device may be ball-type check valve, plate-type check valve, and flapper-type check valve. The one or more uni-directional flow control devices are adapted to be opened by fluid flow from the formation and to be closed by pressure from a fluid column in the flow conduit when the fluid flow is shut off. In another arrangement, an isolation system and method includes a valve, a string having a flow conduit (e.g., tubing, flow tube, etc.) and a lower end, and an actuation tool (e.g., a shifting tool) attached to the lower end of the string and adapted to operate the valve if the string is lowered into or raised out of the wellbore.

44 Claims, 8 Drawing Sheets

METHOD AND APPARATUS FOR FORMATION ISOLATION IN A WELL

This application claims priority under 35 U.S.C. § 119(e) to U.S. Provisional Application Serial No. 60/117,304, entitled "Formation Isolation in a Well," filed Jan. 26, 1999. This application is a continuation-in-part of Ser. No. 09/441,817, now U.S. Pat. No. 6,302,216 entitled "Flow Control and Isolation in a Wellbore," filed Nov. 17, 1999, which in turn claims priority under § 119(e) to U.S. Provisional Application Serial No. 60/108,910, entitled "Well Completion System for Isolation and Flow Control," filed Nov. 18, 1998, and U.S. Provisional Application Serial No. 60/108,953, entitled "Multiple Valve System for Flow Control," filed Nov. 18, 1998.

BACKGROUND

The invention relates to a method and apparatus for isolating a formation when completion equipment is removed from a well.

A completion string may be positioned in a well to produce fluids from one or more formation zones. Completion devices may include casing, tubing, packers, valves, pumps, sand control equipment, and so forth to control the production of hydrocarbons. During production, fluid flows from a reservoir in the formation through the perforations and casing openings into the wellbore and up a production tubing to the surface. The reservoir may be at a sufficiently high pressure such that natural flow may occur despite the presence of opposing pressure from the fluid column present in the production tubing. However, over the life of a reservoir, pressure declines may be experienced as the reservoir becomes depleted. When the pressure of the reservoir is insufficient for natural flow, artificial lift systems may be used to enhance production. Various artificial lift mechanisms may include pumps, gas lift mechanisms, and other mechanisms. One type of pump is the electrical submersible pump (ESP).

If a failure occurs in one or more completion components located downhole, then a portion of the completion string may need to be removed from the wellbore for repair at the surface. Such repair may take an extended amount of time, e.g., days or weeks. After repair is completed, the completion string portion may be lowered back into the wellbore and re-positioned to again start well production.

When an upper section of the completion string (e.g., production tubing, packers, pumps, etc.) is removed from the wellbore, some action may be taken to ensure that formation fluid does not continue to flow to the surface. This is typically done, for example, by applying some type of heavy weight fluid (also referred to as "kill fluid") into the wellbore to "kill" the well, that is, to prevent fluid flow from the formation to the surface during work-over operations. Another technique to kill a well includes application of "fluid loss control pills," which involves application of a heavy weight chemical to plug perforations in the formation. However, such techniques to kill a well may damage a formation and result in loss of production. Thus, a need exists to protect a formation from damage when a section of a completion string is removed from a well.

SUMMARY

In general, according to one embodiment, an apparatus for use in a wellbore that passes through a formation includes a flow conduit capable of receiving a fluid flow from the formation and an isolation system coupled to the flow conduit and including one or more uni-directional flow control devices. The one or more uni-directional flow control devices are adapted to be opened by fluid flow from the formation and to be closed by pressure from a fluid column in the flow conduit when the fluid flow is shut off.

In general, according to another embodiment, an apparatus for use in a wellbore includes a valve, a string having a flow conduit and a lower end, and an actuation tool attached to the lower end of the string and adapted to operate the valve if the string is lowered into or raised out of the wellbore.

Other features and embodiments will become apparent from the following description, from the drawings, and from the claims.

DETAILED DESCRIPTION

In the following description, numerous details are set forth to provide an understanding of the present invention. However, it will be understood by those skilled in the art that the present invention may be practiced without these details and that numerous variations or modifications from the described embodiments may be possible.

As used here, the terms "up" and "down"; "upper" and "lower"; "upwardly" and downwardly"; and other like terms indicating relative positions above or below a given point or element are used in this description to more clearly described some embodiments of the invention. However, when applied to equipment and methods for use in wells that are deviated or horizontal, such terms may refer to a left to right, right to left, or other relationship as appropriate.

It may be desirable to pull a portion of the completion string out of the wellbore under certain conditions, such as for repairing damaged or defective components. When a portion of the completion string is pulled out of the wellbore, fluid loss control of a perforated formation is needed. To avoid communication of kill fluids or fluid loss control pills that may damage the formation, an interventionless formation isolation system in accordance with some embodiments may be employed. An interventionless formation isolation system can be operated without having to lower mechanical shifting or setting tools to the formation isolation system, which may be difficult due to the presence of various downhole components. One such component includes pumps, such as an electrical submersible pump (ESP) or other type of pump that does not have a full bore through which a shifting tool or other like actuation tool may pass through. In addition, having to run an intervention tool into a wellbore is a time consuming and expensive operation. The interventionless formation isolation system in accordance with some embodiments also does not require application of a signal (e.g., electrical, pressure pulse, or hydraulic signals) from the well surface for operation.

In some embodiments, closing of the formation isolation system may be "automatic" when a portion of the completion string is pulled out of the wellbore. In one arrangement, an operator member may be attached to the lower end of the completion string portion so that as the completion string portion is pulled out, the operator member engages and automatically closes the formation isolation system. In another arrangement, uni-directional flow control devices may be used to enable fluid flow out of the formation but to prevent fluid flow into the formation. Thus, a pressure present in the wellbore (which may be pressure from kill fluids or pressure from an existing fluid column in the wellbore) may close or shut off the uni-directional flow control devices.

Figure 1:
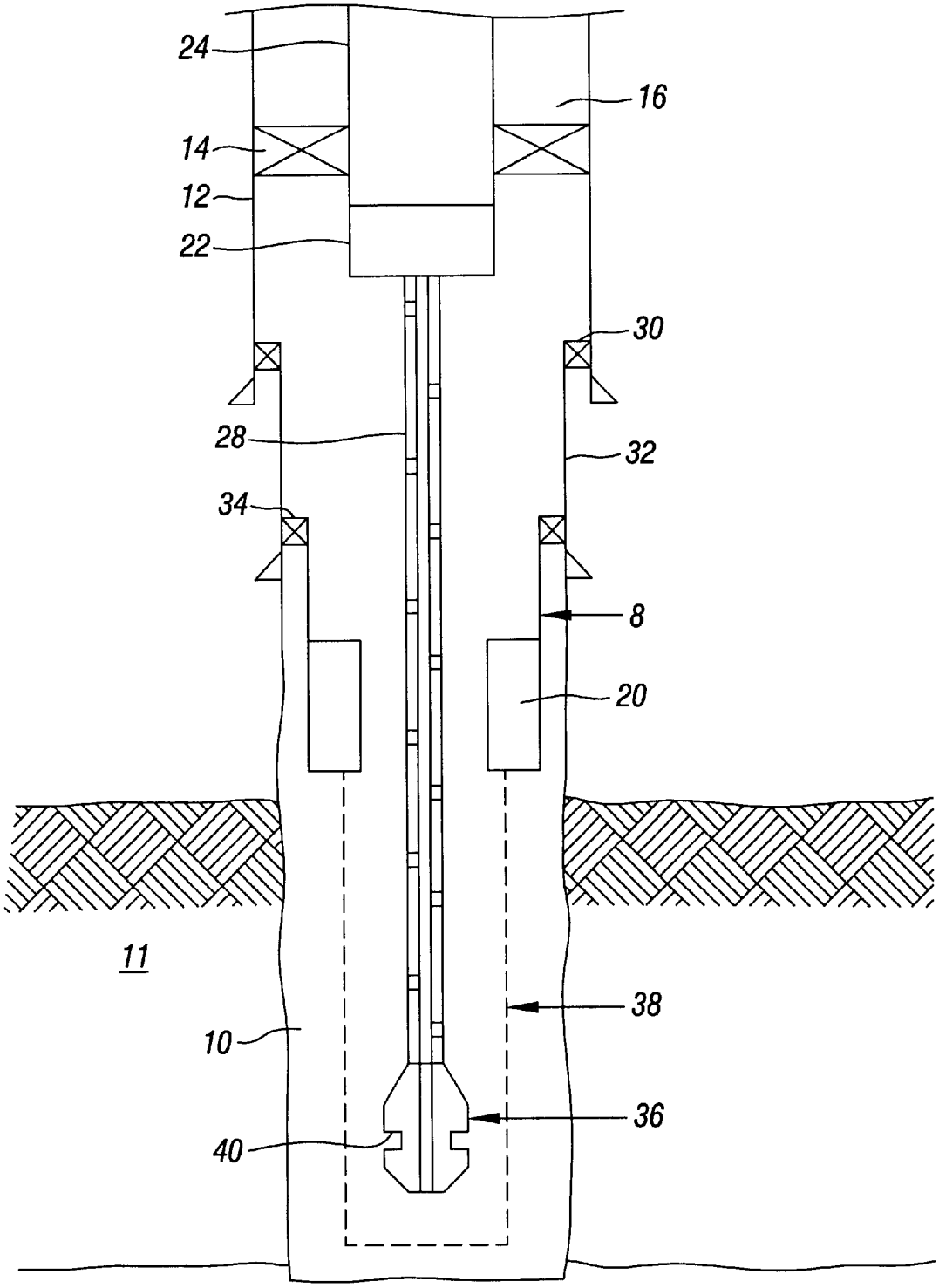
FIG. 1 illustrates an embodiment of a completion string including a formation isolation system in accordance with one embodiment in a wellbore.

Referring to FIG. 1, in accordance with the first arrangement, a completion string in a wellbore 10 includes a formation isolation system 8 that has a formation isolation valve (FIV) 20 (which may include a ball valve, a flapper valve, or other type of valve). When in its closed position, the FIV 20 isolates a formation 11 to prevent fluid loss after a portion of the completion string is removed from the wellbore 10. In addition, the FIV 20 can protect the formation 11 from kill fluids or other chemicals that control formation fluid loss, if they are used. According to some embodiments, the formation isolation system 8 is an interventionless system since access to the FIV 20 may be difficult through certain completion devices located above the valve.

The completion string illustrated in FIG. 1 includes a production tubing 24 positioned in a section of the wellbore 10 that is lined with casing 12. In addition, a packer 14 isolates an annulus region 16 between the production tubing 24 and the casing 12. The end of the production tubing 24 may be attached to a pump assembly 22, which may include an electrical submersible pump (ESP) or other type of pump, a seal section, a motor, and a monitoring pack, for example. A liner 32 may be attached below the casing 12. A packer 30 seals the outside of the liner 32 and the inside of the casing 12, and a packer 34 seals the outside of the formation isolation system 8 and the inside of the liner 32. Although the illustrated embodiment has a certain arrangement of completion components, further embodiments may have other arrangements.

The lower end of the pump assembly 22 may be attached to a slotted flow tube 28 that extends into a lower section of the wellbore 10, which may either be an open hole region or lined region. The collection of the flow tube 28 and production tubing 24 may be referred to as a "flow conduit." More generally, a flow conduit may refer to any collection of one or more tubings, pipes, channels, or other types of flow paths.

A sand screen 38 may be positioned under the formation isolation system 8 for sand control so that fluid can be produced through the slotted flow tube 28 without also producing sand. The annulus region outside the sand screen 38 may be gravel packed. Fluids from the formation 11 pass through openings in the slotted flow tube 28 and flow up the inner bore of the production tubing 24.

In the illustrated arrangement, the FIV 20 is maintained in an open position during production. The end of the slotted flow tube 28 may be attached to a shifting or actuation tool 36 that is adapted to operate the FIV 20. The shifting tool 36 includes a latch profile 40 that latches onto a corresponding profile in the operating mechanism of the FIV 20 as the shifting tool 36 is lowered or raised through the FIV 20. Thus, as the completion string is being installed, the shifting tool 36 attached at the end of the string engages the FIV 20 to open it. Further, when an upper portion of the completion string, which may include the production tubing 24, the retrievable packer 14, the pump assembly 22, and the slotted flow tube 28, is retrieved to the well surface, such as for repair, the shifting tool 36 engages the FIV 20 to close it. This provides interventionless and automatic operation of the FIV 20 so that a separate run of a shifting tool into the wellbore or application of signals from the well surface can be avoided.

Figure 2:
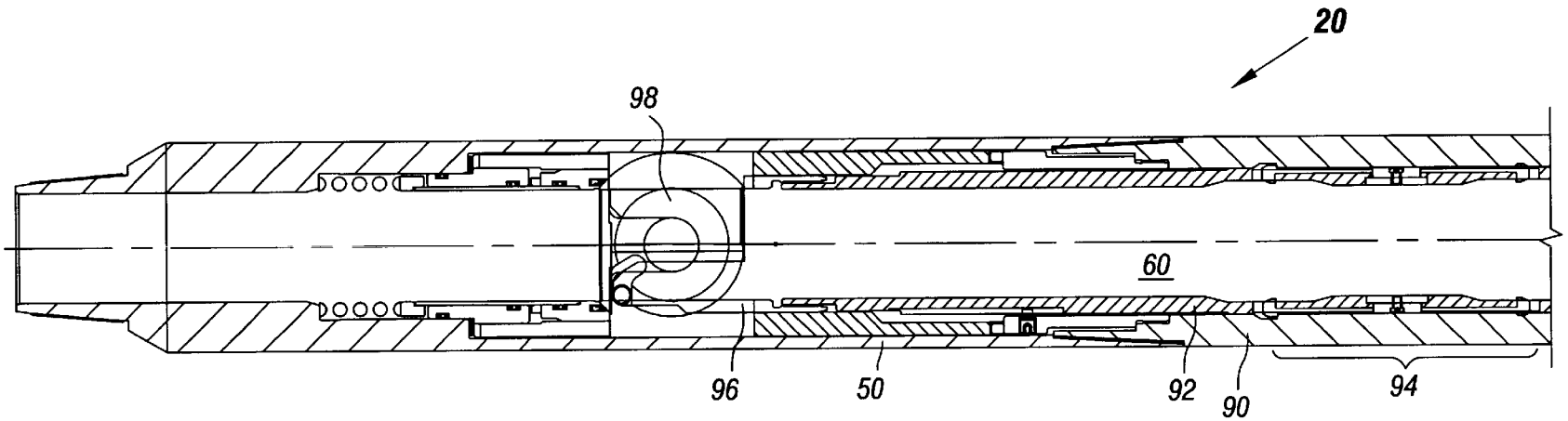
FIG. 2 is a longitudinal sectional view of a formation isolation valve (FIV) in the completion string of FIG. 1.

Referring to FIG. 2, a portion of the FIV 20 in accordance with one embodiment is illustrated in greater detail. The FIV 20 includes a ball valve 98 contained within a housing 50 of the FIV 20. The ball valve 98 is shown in its open position so that the bore of the ball valve 98 is aligned with an inner bore 60 defined by the housing 50 to enable fluid flow through the FIV 20.

The ball valve 98 is operably coupled to an operator member 96, which is threadably connected to a shifting mandrel 92. A latch section 94 is attached to the shifting mandrel 92. The latch section 94 is adapted to be engaged by the engagement profile 40 of the shifting tool 36 coupled below the flow tube 28 (FIG. 1). As the shifting tool 36 passes through the inner bore 60 (either in an upward or downward direction), the latch profile 40 of the shifting tool 36 engages the latch section 94 to shift the mandrel 92 upward or downward to actuate the ball valve 98 to an open or closed position.

In operation, the formation isolation assembly 8 may be initially installed into the wellbore with the sand control assembly 38 or after the sand control assembly 38 has been installed. After the packer 34 is set, closing of the FIV 20 allows isolation of the formation 11 to prevent fluid loss to the surface. The remainder of the completion string may then be installed. As the lower part of the completion string is installed, the flow tube 28 and shifting tool 36 are passed through the FIV 20 to open it.

After the completion string has been installed, certain components of the completion string may fail, which may require that a portion of the completion string be pulled out of the wellbore 10 for repair operations. As the portion of the completion string is removed from the wellbore 10, the attached shifting tool 36 is passed through the FIV 20, which operates the operator mechanism of the FIV to close the valve. When the FIV 20 is closed, the section of the wellbore 10 below the FIV 20 is isolated from the portion of the wellbore 10 above the FIV 20. Thus, fluids, such as kill fluids, that may be applied into the wellbore 10 under pressure from the surface for well control are isolated from the formation 11 by the FIV 20. This protects the formation 11 from damage caused by such kill fluids while at the same time prevents formation fluid from flowing to the surface. Optionally, since the FIV 20 has isolated the formation 11 for fluid loss control, application of kill fluids may not be necessary.

When the completion string portion is again lowered back into the wellbore 10 with the FIV shifting tool 36 attached at the end, the FIV 20 is reopened to again start production of fluids. Removal and reinsertion of completion equipment may be performed multiple times, each time closing and opening the FIV 20 automatically as the flow tube 28 and shifting tool 36 are passed through the FIV 20.

Another benefit of the FIV 20 is that the same valve may be used for isolating the formation during initial sand face completion and then subsequently to isolate the formation during a work-over operation after a portion of the completion string has been removed. As a result, the need for additional valves may be avoided. In addition, when a portion of completion string is removed for a work-over operation, another tool (e.g., an evaluation tool) may be run down into the wellbore with a shifting tool attached to open and close the FIV so that a separate trip to actuate the valve is not needed. By using an FIV that includes a ball valve, a separate tool to actuate a valve such as a plug or a flapper-type isolation valve is not needed. The formation isolation system according to some embodiments may be reliable and relatively simple to implement at low cost, since a relatively small number of moving parts are needed. Further, the formation isolation system may be easily adapted to the size of many types of completion equipment.

Figure 3:
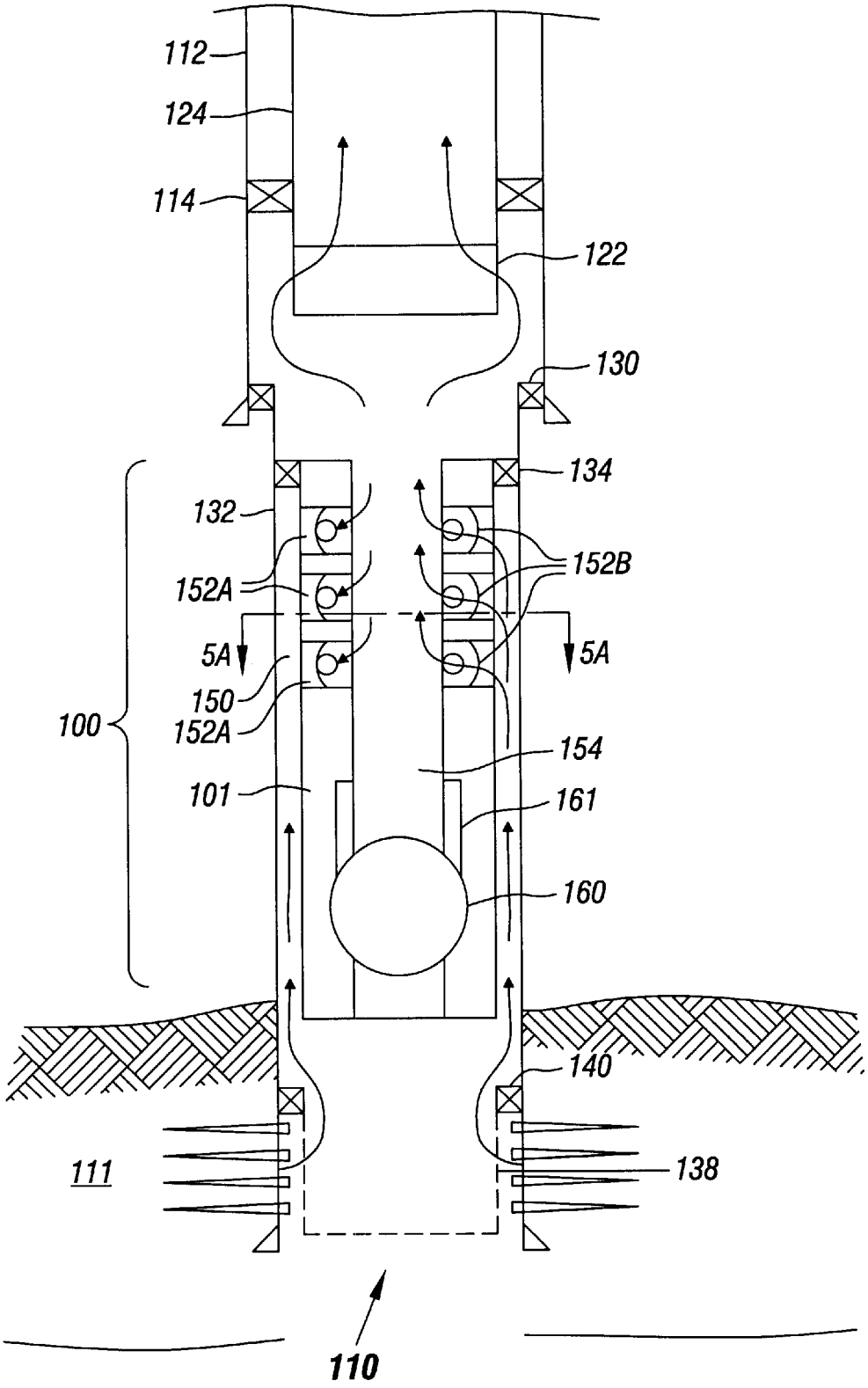
FIGS. 3 and 4 are diagrams of completion strings including formation isolation systems in accordance with farther embodiments.

Referring to FIG. 3, according to another embodiment, another type of isolation system 100 used to isolate a formation 111 includes a plurality of uni-directional flow control devices 152, referred to as flow restrictors, that allow fluid flow upwardly (from the formation) but not downwardly (into the formation). The flow restrictors 152 may be mounted in the housing 101 of the formation isolation system 100. "Housing" as used here may refer to a singular housing or plural housing segments attached together. Production fluid can flow from the formation 111 through the flow restrictors 152, but fluids in the flow conduit including a production tubing 124 are blocked from the formation 111 by the flow restrictors 152. Such fluids may be kill fluids or any other type of fluid.

For illustration purposes, flow restrictors 152A are shown in the closed position, while flow restrictors 152B are shown in the open position. Normally, the flow restrictors are either all open (in the presence of an upward flow of fluid) or all closed (in the presence of downward pressure applied from above). Three sets of flow restrictors 152 are illustrated in FIG. 3 are positioned at three different depths. The distance between any two sets of flow restrictors may be some predetermined distance (e.g., at least about three inches). Multiple flow restrictors 152 may be positioned at each depth.

As illustrated in FIG. 3, the completion string includes a casing 112, the production tubing 124, a packer 114, and a pump assembly 122 (which may include an electrical submersible pump or other type pump). A liner 132 is attached below the casing 112, and a packer 130 seals the outside of the liner 132 and the inside of the casing 112. Further, an annulus region 150 is defined between the outer wall of the formation isolation system 100 and the inner wall of the liner 132. An isolation packer 134 seals the annulus region 150 from the section of the wellbore 110 above the isolation system 100.

Fluid in the annulus region 150 is able to flow through the uni-directional flow restrictors 152 (see flow restrictors 152B) into an inner bore 154 of the formation isolation system 100, as indicated by arrows pointing upwards. However, if fluid is applied under pressure (which may be hydrostatic pressure from the fluid column or an applied pressure) from above the formation isolation system 100, then the flow restrictors are closed, blocking fluid flow from the inner bore 154 of the formation isolation system 100 into the annulus region 150 (see flow restrictors 152A).

Figure 6A:
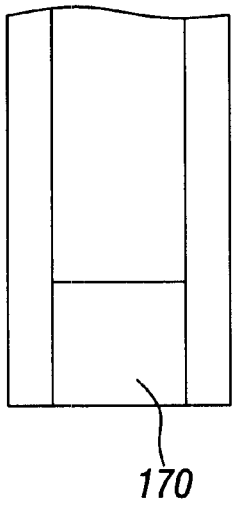
FIGS. 6A and 6B illustrate retrievable plugs that may be used in the embodiments of FIGS. 3 and 4.

Below the assembly of flow restrictors 152, the isolation system 100 may also include a ball valve 160, which is normally in a closed position so that fluid flow does not occur through the ball valve 160. The ball valve 160 is actuatable by an operator mechanism 161. Normally, the ball valve 160 is closed. However, if access to the wellbore section below the ball valve 160 is desired, the ball valve 160 may be actuated open to allow an intervention tool access through the bore of the ball valve 160. The ball valve 160 may be opened and closed multiple times. Thus, for example, formation evaluation tools may be run into the wellbore 110 after the upper completion string portion has been removed to access the formation below the isolation system 100. Such evaluation tools may be used to determine characteristics of the formation 111. In an alternative embodiment, instead of the ball valve 160, the formation isolation system 100 may include a retrievable plug 170, as shown in FIG. 6A. The retrievable plug 170 may be retrieved using a wireline or slickline if access to the formation 111 below the isolation system 100 is desired.

Below the isolation system 100 may be a sand screen 138 that is positioned next to a perforated section of the liner 132 and the formation 111. A completion packer 140 connected to the sand screen 138 may be placed above the perforated section so that fluid flow occurs through the sand screen 138 into the wellbore 110. Thus, fluid from the formation 111 flows into the wellbore 110 and into the annulus region 150, through the flow restrictors 152 into the inner bore 154 of the formation isolation system 100, and into the tubing 124.

Figure 5A:
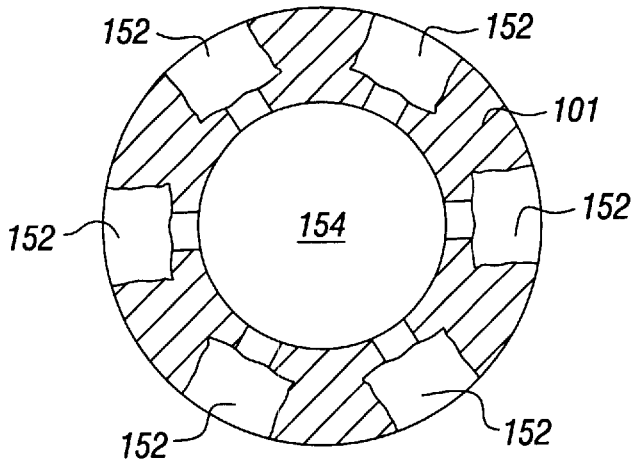
FIG. 5A is a cross-sectional view of the formation isolation system of FIG. 3.

A cross-section of an embodiment of the formation isolation system housing 101 and flow restrictors 152 taken along section 5A—5A is illustrated in FIG. 5A. In the illustrated embodiment, six flow restrictors 152 may be mounted around the circumference of the housing 101. Each flow restrictor 152 provides a channel from the annulus region 150 into the inner bore region 154 of the formation isolation system 100.

Figure 5B:
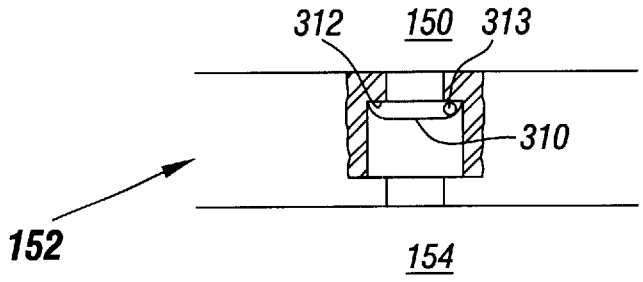
FIGS. 5B–5C illustrate ball-type and flapper-type uni-directional flow restrictors, respectively, that are useable in the embodiments of FIGS. 3 and 4.
Figure 5C:
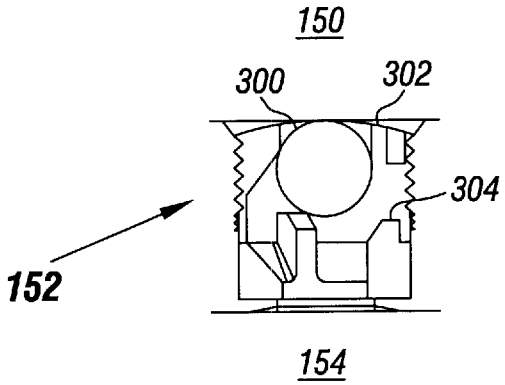

As illustrated in FIG. 5C, according to one embodiment, each flow restrictor 152 may include a floating ball 300, a generally conical ball seat 302, and a retainer member 304. When pressure is applied from inside the formation isolation system, the floating ball 300 is pushed against the ball seat 302 to form a seal so that the flow restrictor is blocked off or closed. If fluid pressure is from the annulus region 150, the floating ball 300 is pushed away from the seat 302 towards the retainer member 304 to place the flow restrictor 152 in the open position. When open, fluid may easily flow around the ball 300. This type of flow restrictor may be referred to as the "ball-type" flow restrictor or check valve.

In an alternative embodiment, as illustrated in FIG. 5B, the flow restrictor 152 may include a flapper-type valve that includes a flapper 310. If pressure is applied in the inner bore 154, the flapper 310 is pushed against a shoulder 312 in the flow restrictor 152 to form a fluid seal. However, if fluid pressure is from the annulus region 150, then the flapper 310 is pushed away from the shoulder 312 and rotated about a pivot 313. Once the flapper 310 is opened, fluid can flow through the flow restrictor 152. This type of flow restrictor may be referred to as the "flapper-type" flow restrictor or check valve.

Figure 4:
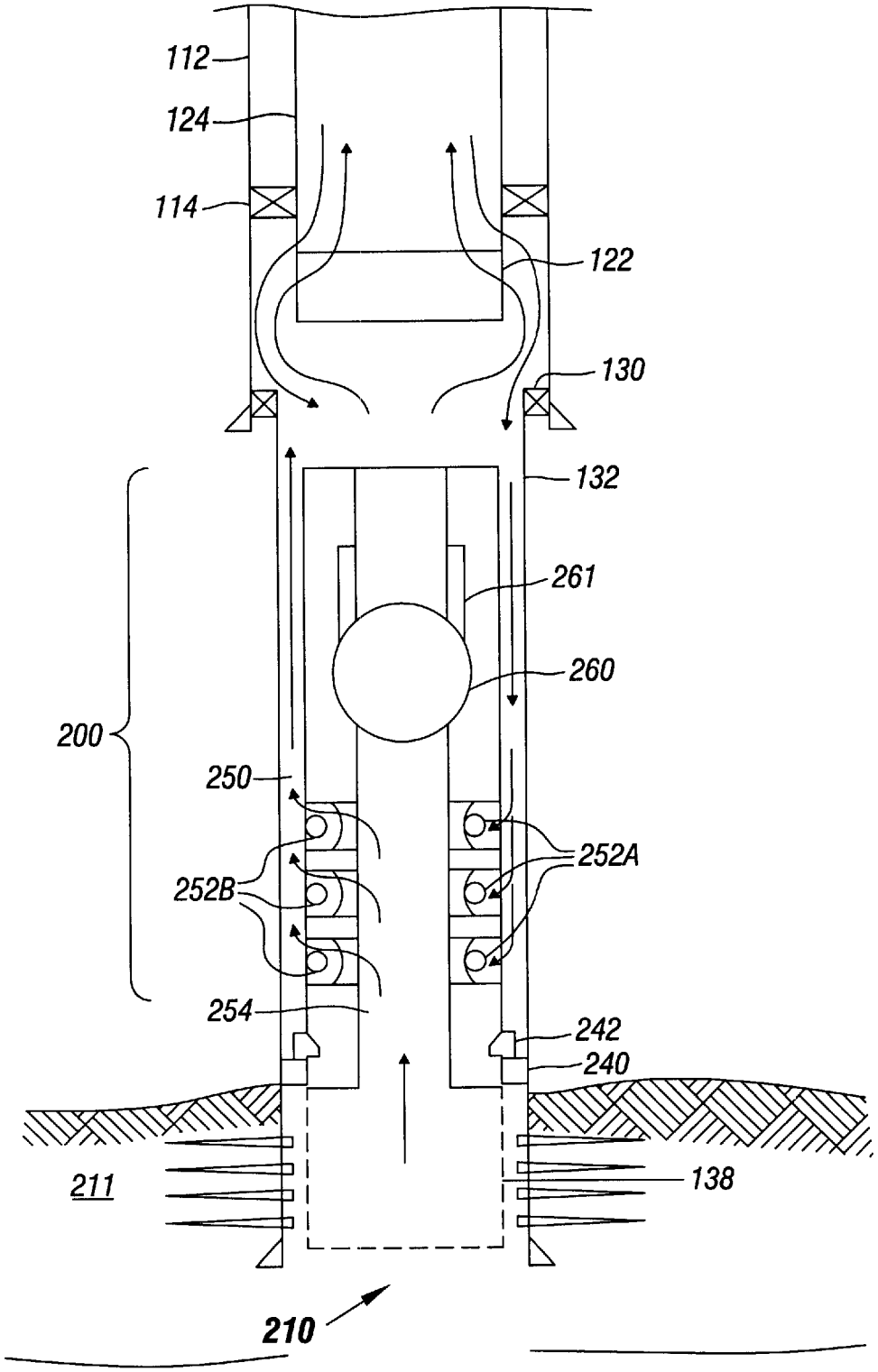
Figure 6B:
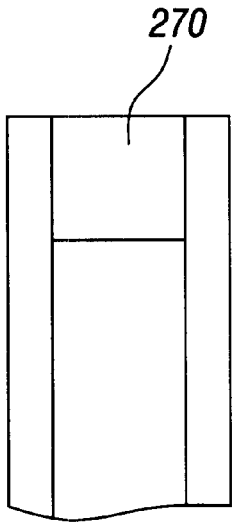

Referring to FIG. 4, another embodiment of a formation isolation system 200 is illustrated. Components in the system 200 that are common to components in the system 100 have the same reference numerals. In the FIG. 4 embodiment, the isolation system 200 does not include an isolation packer (such as isolation packer 134 in FIG. 3). Instead, the isolation system 200 at its lower end is sealably attached to a completion packer 240 and a ball valve 260 (or alternatively, a plug 270 shown in FIG. 6B) is positioned in the inner bore 254 of the isolation system 200 above uni-directional flow restrictors 252 (rather than below as shown in FIG. 3).

A latch mechanism 242 is used to latch the formation isolation system 200 to the completion packer 240. The sand screen 138 is still attached below the completion packer 240 next to perforations in the formation 211. Fluid from the formation 211 flows through sand screen 138 into the wellbore 210 and up the inner bore 254 of the isolation system 200. The formation fluid then flows through the flow restrictors 252 (252B shown in open position) and into an annulus region 250 between the outer wall of the formation isolation system 200 and the liner 132. The formation fluid then flows into the production tubing 124 with assistance from the pump assembly 122.

As illustrated, the flow restrictors 252 allow fluid flow upwards from the formation 211 to the annulus region 250. However, if the upper portion of the completion equipment is removed and production flow stops, pressure from the fluid column in the tubing 124 is communicated into the annulus region 250 to shut off the flow restrictors 252 (see flow restrictors 252A).

Figure 7A:
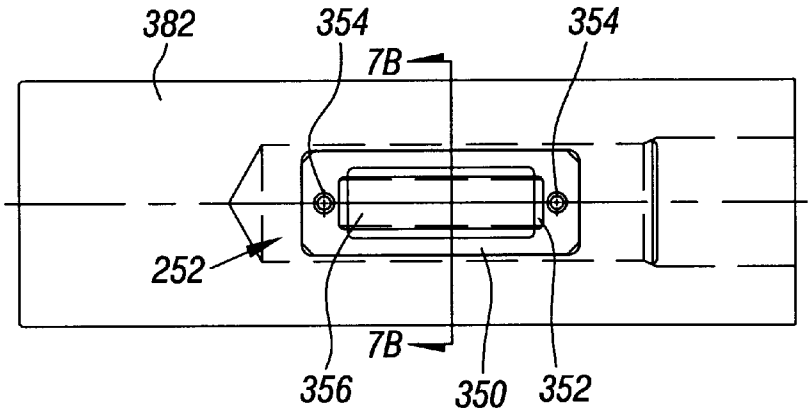
FIGS. 7A–7C illustrate a plate-type flow restrictor useable in the embodiments of FIGS. 3 and 4.
Figure 7C:
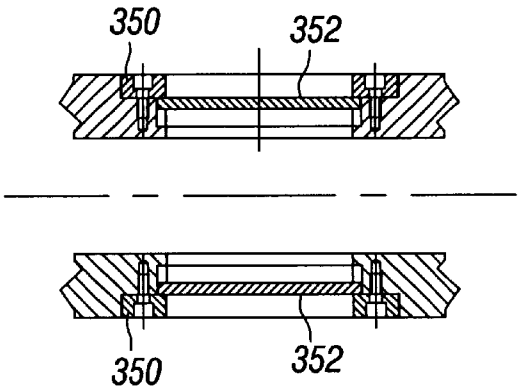
Figure 7B:
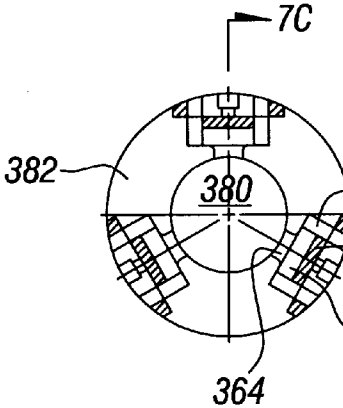

Referring to FIGS. 7A–7C, yet another embodiment of a flow restrictor (252) is illustrated. Instead of a ball-type flow restrictor (FIG. 5C) or a flapper-type flow restrictor (FIG. 5B), a plate-type flow restrictor is used. A cover 350 having an opening 356 is connected to a housing 382 by screws 354. Below the cover 350 is a plate 352 that has a length that is slightly greater than the length of the opening 356 in the cover 350. As shown in FIG. 7B, the plate 352 is moveable in a cavity or chamber 362 defined by walls 360. The cavity 362 leads into an orifice 364 that is in communication with the inner bore 380 of the housing 382.

The flow restrictor 252 as shown in FIGS. 7A–7C is usable with the formation isolation system 200 of FIG. 4, where production flow from the formation 211 enters the bore 254 of the system 200 and exits through the flow restrictors 252. If the production flow is stopped, then pressure in the production tubing 124 communicated through the annulus 250 shuts off the flow restrictors 252 by pushing the plate 352 in each restrictor 252 into sealing engagement with the corresponding orifice 364. Fluid flow in the other direction pushes the plate 352 away from the orifice 364 to allow flow through the restrictor.

Figure 8:
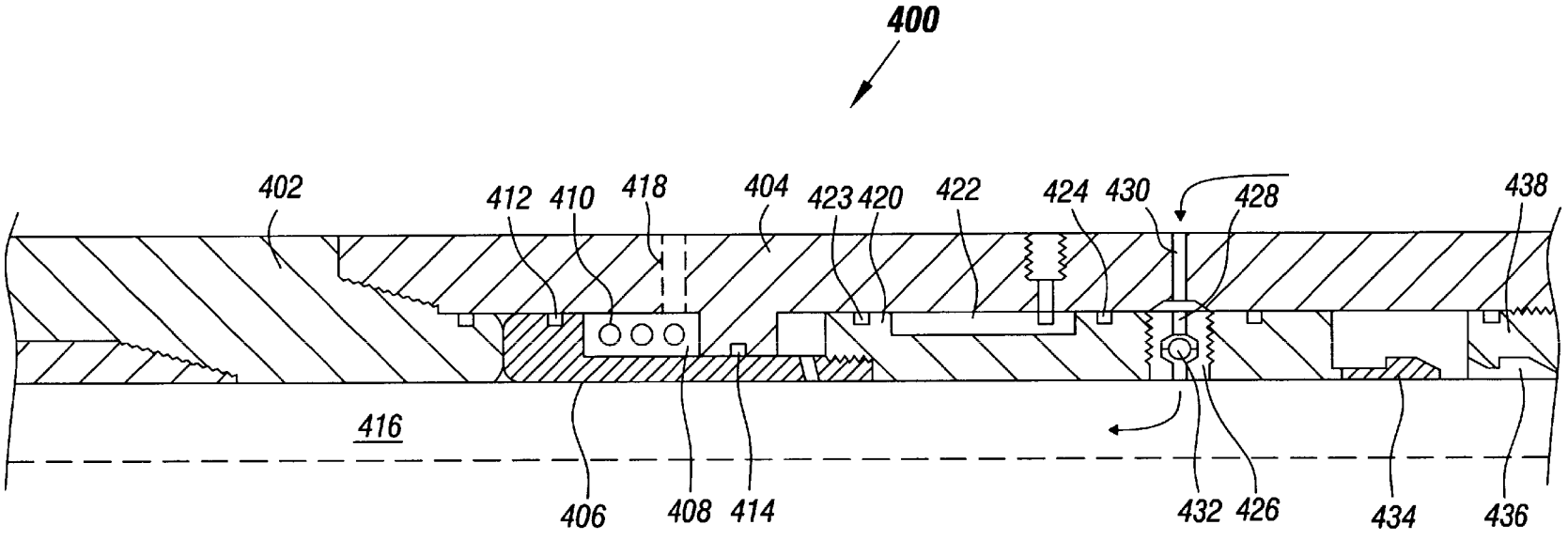
FIG. 8 is a longitudinal sectional view of an uni-directional flow control device in accordance with another embodiment including a ball-type flow restrictor and a sleeve.

The several embodiments of the flow restrictors 152 or 252 shown in FIGS. 5B, 5C, and 7A–7C are useable (with modifications as needed) in either of the formation isolation system 100 or 200. However, the illustrated restrictors may riot provide a fall seal, as some leakage may occur through the flow restrictors discussed above. If a good seal is desired, then a flow control device 400 as shown in FIG. 8 may be used. The flow control device 400 includes a top sub 402 attached to a housing 404. A spring mandrel 406 is moveably arranged inside the housing 404. A spring chamber 408 is defined between a narrowed section of the spring mandrel 406 and the inner wall of the housing 404. A spring 410 may be placed in the spring chamber 408 to apply an upward force (to the left of diagram) on the spring mandrel 406. Seals 412 and 414 above and below the spring chamber 408 prevent fluid in the inner bore 416 of the housing 404 from being communicated into the chamber 408. A port 418 defined in the housing 404 may communicate annulus fluid pressure into the spring chamber 408.

The lower end of the spring mandrel 406 is threadably connected to a flow mandrel 420. The outer surface of the flow mandrel 420 defines a recessed section 422 that is sealed on either side by seals 423 and 424. One or more check valve 426, which in the illustrated embodiment include ball-type check valves, may be mounted in the flow mandrel 420. In the illustrated position, the flow path in each check valve 426 is aligned with a corresponding port 430 in the housing 404. An arrow representing fluid flow indicates that flow is coming from the formation and into the one or more ports 430. This allows a ball 432 in each ball-type check valve 426 to be pushed away from its seat to allow fluid flow into the inner bore 416.

The lower end of the flow mandrel 420 is connected to collet fingers 434. The collet fingers 434 are adapted to be engaged in corresponding profiles 436 defined by a member 438 connected to the housing 404.

During normal operation, production fluid flow can flow through the port 430 and check valve 426 into the inner bore 416 of the flow control device 400 for communication to a production tubing. However, once the fluid flow is shut off, fluid pressure in the inner bore 416 pushes the ball 432 of the check valve 426 back onto its seat to substantially block fluid flow. However, some leakage may occur through the check valve 426, which may be undesirable in some applications. To provide a better seal, an elevated pressure may be applied in the inner bore 416 of the flow control device 400. When the inner bore pressure exceeds the annulus fluid pressure by some predetermined amount, the spring mandrel 406 is pushed downwardly, compressing the spring 410. This in turn moves the flow mandrel 420 downwardly, which causes the seal 424 to cross the port 430 so that the port 430 is isolated on both sides by seals 423 and 424 carried in the mandrel 420. The seal provided by the flow mandrel 420 is similar to that provided by sliding sleeve valves. Thus, as used here, the flow mandrel 420 may also be referred to as "sleeve" that is moveable in the flow control device 400 to cover or uncover the port 430.

To uncover the port 430 again, fluid flow may be started in the tubing bore (and thus the inner bore 416 of the flow control device 400). This may be accomplished in one embodiment by turning on a pump (such as an ESP). Flow of fluid in the tubing bore lowers the pressure in the tubing bore and inner bore 416 so that a pressure differential is created between the annulus region and the inner bore 416. The annulus pressure communicated through port 418 thus acts upwardly against the spring mandrel 406 to move the spring mandrel 406 and flow mandrel 420 upwardly to align the check valve 426 with the port 430. This allows fluid pressure to flow through the port 430 and check valve 426 into the inner bore 416.

Advantages offered by some embodiments according to FIGS. 3 and 4 may include the following. Using an interventionless mechanism, the isolation system may protect the formation from being damaged from kill fluids during a work-over operation. A further benefit is that the interventionless mechanism is able to restrict flow from the production tubing to the formation if the pump is stopped, for example, during a work-over operation or for some other reason. Fluid loss is prevented when the pump is stopped and pulled out. The interventionless mechanism provides a reliable and convenient way of resuming formation fluid production once the pump is again turned back on.

Additionally, a plug (such as a ball valve or a simple retrievable plug) may be opened and reclosed to run an intervention tool through the isolation system. By using a ball valve, a separate trip to pull a plug or to run in a sleeve to hold a flapper type isolation valve open and then another trip to run back the plug back in the hole or to run in to pull the sleeve out are avoided. The isolation system according to some embodiments is relatively simple, reliable, and low cost, as the isolation system includes a relatively small number of moving parts.

Flow rate may be increased simply by adding additional flow restrictors. The formation isolation assembly may be easily retrieved for repair if necessary. In addition, the isolation assembly is easily adaptable to any type of completion size. Further, the formation isolation system according to some embodiments may be less sensitive to debris and scale build up as compared to other formation isolation devices.

While the invention has been disclosed with respect to a limited number of embodiments, those skilled in the art will appreciate numerous modifications and variations therefrom. It is intended that the appended claims cover all such modifications and variations as fall within the true spirit and scope of the invention.

What is claimed is:

1. An apparatus for use in a wellbore that passes through a formation, comprising:

a flow conduit capable of receiving a fluid flow from the formation; and an isolation system coupled to the flow conduit and comprising:

a housing having one or more side ports; and one or more uni-directional flow control devices mounted in the corresponding one or more side ports, the uni-directional flow control devices being adapted to be opened by fluid flow from the formation and to be closed by pressure from a fluid column in the flow conduit when the fluid flow is shut off.

2. The apparatus of claim 1, further comprising a pump to create fluid flow from the formation into the flow conduit.

3. The apparatus of claim 2, wherein the pump is turned off to shut off fluid flow.

4. The apparatus of claim 1, wherein each of the one or more uni-directional flow control devices includes a ball-type check valve.

5. The apparatus of claim 1, wherein each of the one or more uni-directional flow control devices includes a plate-type check valve.

6. The apparatus of claim 5, wherein the plate-type check valve includes an orifice, a chamber, and a plate moveable in the chamber to cover and uncover the orifice.

7. The apparatus of claim 1, wherein each of the one or more uni-directional flow control devices includes a flapper-type check valve.

8. The apparatus of claim 1, further comprising:

a tubular housing having an inner bore, the one or more uni-directional flow control devices mounted in the tubular housing, the one or more flow control devices adapted to enable fluid flow between an annular region outside the housing and the housing inner bore.

9. The apparatus of claim 1, wherein the isolation system comprises plural uni-directional flow control devices, and wherein the housing comprises plural side ports.

10. The apparatus of claim 1, further comprising an isolation valve that is positioned downstream of the one or more uni-directional flow control devices and that is actuatable to an open position, the isolation valve having a path through which an intervention tool is passable.

11. The apparatus of claim 10, wherein the isolation valve comprises a ball valve.

12. The apparatus of claim 1, further comprising a removable plug positioned downstream of the one or more uni-directional flow control devices.

13. An apparatus for use in a wellbore that passes through a formation, comprising:

a flow conduit capable of receiving a fluid flow from the formation; and an isolation system coupled to the flow conduit and comprising one or more uni-directional flow control devices, the uni-directional flow control devices being adapted to be opened by fluid flow from the formation and to be closed by pressure from a fluid column in the flow conduit when the fluid flow is shut off, wherein each of the one or more flow control devices includes a housing having one or more side ports and an inner bore, one or more check valves to control fluid flow through the one or more side ports to or from the inner bore, and at least one sleeve moveable by fluid pressure in the inner bore to sealably cover the one or more side ports.

14. The apparatus of claim 13, wherein the one or more check valves are closed to allow application of an elevated pressure in the inner bore to move the at least one sleeve.

15. The apparatus of claim 13, wherein the at least one sleeve is separate from the one or more check valves.

16. An apparatus for use in a wellbore that passes through a formation, comprising:

an isolation device for positioning in the wellbore above the formation, the isolation device having a housing and one or more uni-directional flow restrictors, the housing having an inner bore extending along an entire length of the isolation device, the inner bore unobstructed by the one or more uni-directional flow restrictors, the one or more flow restrictors adapted to open in response to fluid flow from the formation and to close in response to fluid pressure in an opposite direction, and the isolation device further comprising a valve provided to control flow through the inner bore, the valve in the open position providing full bore access through the inner bore and the valve in the closed position to block fluid flow through the inner bore.

17. The apparatus of claim 16, further comprising an upper completion string removably coupled to the isolation device and adapted to receive fluid flow from the formation, wherein the fluid pressure is applied to enable removal of the upper completion string.

18. The apparatus of claim 17, wherein the completion string includes a pump adapted to generate the fluid flow from the formation when activated and to be turned off to apply the fluid pressure.

19. The apparatus of claim 16, wherein the one or more flow restrictors are mounted in the housing and are adapted to communicate formation fluid flow to the inner bore from an annulus region outside the housing.

20. The apparatus of claim 16, wherein the one or more flow restrictors are mounted in the housing and are adapted to communicate formation fluid flow from the inner bore to an annulus region outside the housing.

21. The apparatus of claim 16, wherein the fluid pressure in the opposite direction is applied by a fluid column in the wellbore.

22. The apparatus of claim 21, wherein the formation has a pressure, and wherein the fluid column pressure is greater than the formation pressure.

23. The apparatus of claim 22, further comprising a pump to create a fluid flow from the formation.

24. The apparatus of claim 16, wherein each of the one or more flow restrictors includes a member selected from the group consisting of a ball-type flow restrictor, a plate-type flow restrictor, and a flapper-type flow restrictor.

25. The apparatus of claim 16, wherein the housing has a wall and the one or more flow restrictors are mounted in the wall.

26. The apparatus of claim 16, wherein each of the one or more flow restrictors is selected from the group consisting of a plate-type flow restrictor and a flapper-type flow restrictor.

27. The apparatus of claim 16, wherein the valve comprises a ball valve.

28. The apparatus of claim 16, wherein the housing has one or more side ports, the one or more flow restrictors mounted in the corresponding one or more side ports.

29. A method of operating a well, comprising:

generating fluid flow through an isolation apparatus having one or more uni-directional flow devices from a formation into a flow conduit during normal operation, the isolation apparatus having an inner bore unobstructed by the one or more uni-directional flow devices;

applying a pressure in the well to close the one or more uni-directional flow devices to isolate the formation; and running an intervention tool through the isolation apparatus inner bore and past the one or more uni-directional flow devices.

30. The method of claim 29, wherein applying the pressure includes introducing a kill fluid into the well.

31. The method of claim 29, wherein applying the pressure includes providing pressure by a fluid column in the flow conduit.

32. The method of claim 31, further comprising stopping a pump to stop fluid flow to enable the fluid column pressure to close the one or more uni-directional flow devices.

33. The method of claim 32, wherein providing the fluid column pressure includes providing a pressure greater than the pressure of the formation.

34. The method of claim 29, further comprising removing an upper completion string during a work-over operation and leaving the isolation apparatus in the well.

35. The method of claim 34, further comprising opening a valve positioned downstream of the one or more uni-directional flow devices and running the intervention tool through a bore of the valve.

36. The method of claim 34, further comprising removing a plug positioned downstream of the one or more uni-directional flow devices and running the intervention tool after removing the plug.

37. An apparatus for use in a wellbore, comprising:

a flow conduit capable of receiving a fluid flow from the formation; and an isolation system coupled to the flow conduit and including one or more uni-directional flow control devices, wherein each of the one or more flow control devices includes a housing having one or more side ports and an inner bore, one or more check valves to control fluid flow through the one or more side ports to or from the inner bore, and at least one sleeve moveable by fluid pressure in the inner bore to sealably cover the one or more side ports, the one or more uni-directional flow control devices being adapted to be opened by fluid flow from the formation and to be closed by pressure from a fluid column in the flow conduit when the fluid flow is shut off.

38. The apparatus of claim 37, wherein the isolation system comprises plural check valves and plural side ports.

39. The apparatus of claim 38, wherein the plural check valves are mounted in corresponding side ports.

40. The apparatus of claim 37, wherein the at least one sleeve is separate from the one or more check valves.

41. The apparatus of claim 37, wherein the one or more check valves are mounted in corresponding one or more side ports.

42. An apparatus for use in a wellbore that passes through a formation, comprising:

a flow conduit capable of receiving a fluid flow from the formation;

an isolation system coupled to the flow conduit and comprising one or more uni-directional flow control devices, the uni-directional flow control devices being adapted to be opened by fluid flow from the formation and to be closed by pressure from a fluid column in the flow conduit when the fluid flow is shut off; and a pump adapted to create fluid flow from the formation into the flow conduit, wherein each of the one or more uni-directional flow control devices is selected from the group consisting of a plate-type check valve and a flapper-type check valve.

43. The apparatus of claim 42, wherein the plate-type check valve includes an orifice, a chamber, and a plate moveable in the chamber to cover and uncover the orifice.

44. The apparatus of claim 42, wherein the pump is turned off to shut off fluid flow.

* * * * *